United States Patent [19]

Sasaki et al.

[11] Patent Number: 4,790,959

[45] Date of Patent: Dec. 13, 1988

[54] DISPERSION

[75] Inventors: Masao Sasaki; Kaoru Onodera, both of Odawara; Hideki Inahata, Minami-Ahigara, all of Japan

[73] Assignee: Konishiroku Photo Industry Co., Ltd., Japan

[21] Appl. No.: 4,856

[22] Filed: Jan. 12, 1987

Related U.S. Application Data

[63] Continuation of Ser. No. 611,568, May 18, 1984.

[30] Foreign Application Priority Data

May 21, 1983 [JP] Japan ..... 58-89591

[51] Int. Cl.[4] ..... F21V 9/06

[52] U.S. Cl. ..... 252/589; 430/512; 106/180

[58] Field of Search ..... 252/589; 430/512; 106/180

[56] References Cited

U.S. PATENT DOCUMENTS

| | | | |
|---|---|---|---|
| 3,018,269 | 1/1962 | Bruno | 252/589 X |
| 3,072,585 | 1/1963 | Milionis et al. | 252/589 X |
| 3,159,646 | 12/1964 | Milionis et al. | 252/589 X |
| 3,214,436 | 10/1965 | Boyle et al. | 252/589 X |
| 3,218,332 | 11/1965 | Heller et al. | 252/589 X |
| 3,533,794 | 10/1970 | Ohi et al. | 252/589 X |
| 3,738,837 | 6/1973 | Kuwabara et al. | 252/589 X |
| 3,892,889 | 7/1975 | Cohnen et al. | 252/589 X |
| 3,936,305 | 2/1976 | Hiraishi et al. | 252/589 X |
| 4,077,971 | 3/1978 | Fujita et al. | 252/589 X |

*Primary Examiner*—Matthew A. Thexton
*Assistant Examiner*—Catherine S. Kilby
*Attorney, Agent, or Firm*—Finnegan, Henderson, Farabow, Garrett & Dunner

[57] ABSTRACT

A dispersion of oil globules which contains an ultra-violet absorber and a high-boiling solvent is disclosed. The UV absorber is a mixture of 15 to 45 wt % of a compound of formula (I) and 85 to 55 wt % of a compound of formula (II):

(I)

(wherein $R_1$ and $R_2$ each represents an alkyl group having 1 to 4 carbon atoms; X is a hydrogen atom, a halogen atom, a methyl group, an ethyl group, a methoxy group, an ethoxy group or an aryl group);

(II)

(wherein $R_3$ and $R_4$ each represents an alkyl group, provided that the total number of carbon atoms in the alkyl groups represented by $R_3$ and $R_4$ is 9 or more; Y is a hydrogen atom, a halogen atom, a methyl group, an ethyl group, a methoxy group, an ethoxy group or an aryl group).

11 Claims, No Drawings

DISPERSION

This application is a continuation of application Ser. No. 611,568 filed May 18, 1984.

BACKGROUND OF THE INVENTION

1. Field of the Invention

The present invention relates to dispersion, more particularly, to dispersion of an ultraviolet absorber suitable for use in a photographic product.

2. Description of the Prior Art

Ultraviolet rays are known to cause many adverse effects on photographic products. For example, electrostatic light caused during the drying of a coated web or during transporting of the finished photographic product induces undesired sensitization. If various light sources having different intensities of UV radiation are used for shooting pictures, the color reproducibility of the photographic product may be impaired.

The possibility of a discolored image due to UV radiation is particularly great with a photographic product of the type that provides a color image of a dye other than that of metallic silver, and if the processed photographic product is put in a display case, a significant discoloration or decoloration of the image may occur owing to sunlight containing a great amount of UV radiation.

If a photographic support made of polyethylene-coated paper is used, ultraviolet radiation deteriorates polyethylene and this may lead to cracking in the support.

A photographic product contains various organic additives and they may often stain the non-image area since they form a colored material when they are decomposed under light. For example, the white background of color photographic paper is subject to yellowing upon illumination with light, and a method to eliminate this problem of light stain is desired.

In order to mitigate the deleterious effects of ultraviolet radiation, a UV absorber is generally incorporated in one or more of the silver halide emulsion layers or non-sensitive photographic layers of the photographic product. While a great number of compounds have been proposed for use as the UV absorber, the latter is required to have the following characteristics:

(1) the absence of absorption in the visible range;

(2) the absence of adverse effects on the photographic product;

(3) high solubility in a high-boiling organic solvent; and (4) a sufficient fastness to light to minimize the effect of prolonged illumination by light.

Typical compounds for use as the UV absorber are shown in U.S. Pat. Nos. 2,685,512, 2,719,086, 2,739,888, 2,739,971, 2,747,996, 2,784,087, 2,811,461, 3,112,338, 3,168,492, 3,206,431, 3,253,921, 3,692,525, and 3,754,919; Japanese patent publication Nos. 4,786/1967, 26,139/1974, 25,337/1975, 12,587/1980 and 36,984/1980; and International Publication No. 01473/1981 and European patent publication No. 57,160.

Several techniques have been proposed for dispersing the ultraviolet absorber. According to the first method, which is generally referred to as the Fischer type dispersion method, the absorber is dispersed as finely divided particles. According to the second method, a UV absorber and other necessary components are dissolved in a water-miscible organic solvent, and then a fillable polymer latex and water sufficient to render the UV absorber and other necessary components insoluble are gradually added to the solution, thereby incorporating the absorber in each particle of the polymer latex. For details of the miscible organic solvent and fillable polymer latex, see Japanese patent application (OPI) Nos. 59,942/1976 and 59,943/1976 (the symbol OPI as used herein means an unexamined published Japanese patent application).

In the third method, a UV absorber and other necessary components are dissolved in a substantially water-insoluble high-boiling organic solvent, and the solution is finely dispersed in a hydrophilic protective colloid to obtain an emulsion of O/W type. Details of this method are given in U.S. Pat. Nos. 2,322,027, 2,801,170, 2,801,171, 2,870,012 and 2,991,177. A specific example of applying this method to a UV absorber for use in photographic materials is shown in U.S. Pat. No. 2,739,888.

Of these three methods, the last mentioned method is most extensively used today because it is adapted to operation on an industrial scale (it causes no increase in the viscosity of the coating solution containing the UV absorber) and provides a sharp peak of absorption by the UV absorber. However, even this method has the following two problems that must be solved before it can be put into actual operation. One problem is well known and relates to the low stability of the emulsion product. Because of this low stability, the dispersed particles become coarse or come out of dispersion in the form of crystals, so as to induce various troubles in the manufacturing process. The other problem has been identified first by the present inventors and it is the low stability in a dark place of a photographic coating containing the UV absorber. This tendency is particularly great under hot and humid conditions, and the coating soon loses its ability to absorb ultraviolet rays under such conditions. This is indeed a serious problem since color photographic papers must sometimes be displayed during a rainy season, or the place where they are displayed may present an environment of locally high humidity as in a semi-closed display case or substantially closed picture-frame or photo-stand.

Several methods have been proposed for solving the first problem by stabilizing the dispersion of a UV absorber, and they can be divided into two groups. The first group of stabilization methods depends on improving the solubility of the UV absorber in a high-boiling organic solvent by introducing a change in its chemical structure and is shown in Japanese patent publication Nos. 26,187/1967, 12,587/1980 and 36,984/1980; and International Publication No. 01473/1981 and European patent publication No. 57,160. However, some of the compounds shown are liquid at room temperature and hence are difficult to handle and cause a loss in the yield of the final product. This unavoidably results in a high cost of manufacture. Furthermore, these compounds are difficult to purify and cause variations in the composition of the final product from one batch to another.

The second group of methods is characterized by using two or more ultraviolet absorbers and is shown in Japanese patent publication Nos. 5,496/1973, 30,493/1973 and 41,572/1973; and Japanese patent application (OPI) No. 85,425/1978.

These methods are effective to some extent in improving the stability of the dispersed particles of a UV absorber against crystallization. However, they are far from being completely satisfactory in that they have a limited effectiveness in preventing the coarsening of dispersed particles over the course of time. Furthermore, none of these methods are capable of solving the second problem, i.e., low storage stability in coating, especially under hot and humid conditions.

Accordingly, it is desired to develop a dispersion of ultraviolet absorber that is suitable for use in the preparation of a highly stable photographic coat and which retains a sufficiently stable dispersibility to provide improved stability in the photographic coating even under hot and humid conditions.

SUMMARY OF THE INVENTION

Therefore, one object of the present invention is to provide a dispersion of an ultraviolet absorber that can be incorporated in a photographic product without losing its desired effect even under hot and humid conditions.

Another object of the present invention is to provide a dispersion of an ultraviolet absorber that can be incorporated in a photographic product without causing an excessive light stain even under hot and humid conditions.

A further object of the present invention is to provide a dispersion of an ultraviolet absorber that is capable of achieving a consistently high UV absorbing effect.

Still another object of the present invention is to provide a stable dispersion of an ultraviolet absorber by a simple and economical method.

These and other objects of the present invention will become apparent by reading the following description.

The above mentioned objects of the present invention can be achieved by a dispersion of oil globules containing a high-boiling solvent and an ultraviolet absorber which is made of a mixture of 15 to 45 wt% of a compound of formula (I) and 85 to 55 wt% of a compound of formula (II):

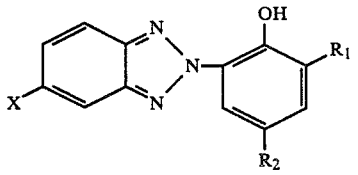

(I)

(wherein $R_1$ and $R_2$ each represents an alkyl group having 1 to 4 carbon atoms; X is a hydrogen atom, a halogen atom, a methyl group, ethyl group, a methoxy group, an ethoxy group or an aryl group);

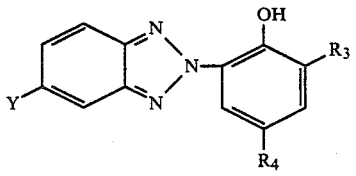

(II)

(wherein $R_3$ and $R_4$ each represents an alkyl group, provided that the total number of the carbon atoms in $R_3$ and $R_4$ is at least 9; Y is a hydrogen atom, a halogen atom, a methyl group, an ethyl group, a methoxy group, an ethoxy group or an aryl group).

DESCRIPTION OF THE PREFERRED EMBODIMENTS

Examples of the group represented by $R_1$ and $R_2$ in formula (I) include methyl, ethyl, propyl and butyl groups. A particularly preferred example of $R_1$ is

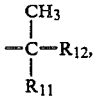

wherein $R_{11}$ and $R_{12}$ each represents a hydrogen atom, a methyl group or an ethyl group, provided that the total number of the carbon atoms in $R_{11}$ and $R_{12}$ is not more than 2, preferably 1 or 2. A preferred example of $R_2$ is a propyl or butyl group. Particularly good results are obtained if $R_1$ is

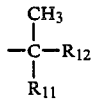

and $R_2$ is a propyl or butyl group.

In formula (II), $R_3$ and $R_4$ may be any alkyl group so long as the total number of carbon atoms in $R_3$ and $R_4$ is not smaller than 9, preferably between 9 and 24. Illustrative examples of such alkyl group include methyl, ethyl, propyl, butyl, amyl, hexyl, heptyl, octyl, nonyl, decyl, undecyl, dodecyl and tridecyl groups. A particularly preferred example of $R_3$ is

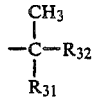

wherein $R_{31}$ and $R_{32}$ each represents a hydrogen atom or an alkyl group, provided that the total number of the carbon atoms in $R_{31}$ and $R_{32}$ is 2 or more, preferably between 2 and 4. A preferred example of $R_4$ is an alkyl group provided that the total number of carbon atoms in $R_3$ and $R_4$ is 9 or more, preferably between 9 and 24. Particularly good results are obtained if $R_3$ is

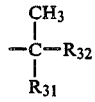

and $R_4$ is an alkyl group having 4 or more carbon atoms.

A particularly preferred compound of formula (I) is such that $R_1$ and $R_2$ are each a tert-butyl or sec-butyl group, and most preferably $R_1$ is the same as $R_2$. A particularly preferred compound of formula (II) is such that $R_3$ and $R_4$ are each a tert-amyl, sec-amyl, tert-hexyl or sec-hexyl group, and most preferably $R_3$ is the same as $R_4$. Using such compounds, a dispersion having an extremely high stability under hot and humid conditions and which experiences minimum light stain can be obtained.

Examples of the group represented by X and Y in formulas (I) and (II), respectively, include a hydrogen atom, a chlorine atom, a bromine atom, a fluorine atom, a methyl group, an ethyl group, a methoxy group, an ethoxy group and an aryl group (e.g. phenyl or tolyl group). For the purpose of minimum light stain, a hydrogen atom or methyl group is preferred as X. With such X, a dispersion having an extremely high stability under hot and humid conditions and which experiences minimum light stain can be obtained. As a further advantage, the possibility of yellowing is appreciably reduced and a photographic product retaining a high degree of whiteness in the background is ensured.

In view of easy synthesis, a hydrogen atom, a chlorine atom, a methyl or methoxy group is preferred as Y.

The compounds of formulas (I) and (II) can be mixed at any weight ratio in the range of 15(I)/85(II) to 45(I)/55(II). A particularly preferred range is from 17:83 to 40:60. If the proportion of compound of formula (I) is less than 15 wt% or more than 85 wt%, the resulting dispersion has an extremely low stability and cannot be used under hot and humid conditions without experiencing a considerable decrease in stability.

In order to attain the intended objects of the present invention, the two specific UV absorbers of formulas (I) and (II) must be mixed at the ratio specified above.

Illustrative examples of the compounds of formulas (I) and (II) are listed below but it should be understood that the scope of the present invention are by no means limited to these examples.

Examples of the UV absorber of formula (I):

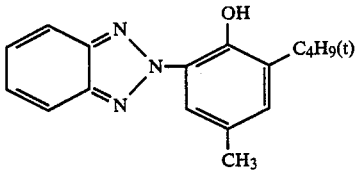
(I-1)

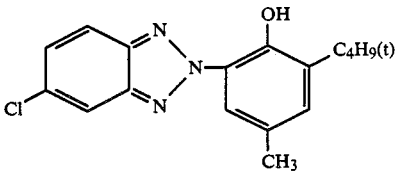
(I-2)

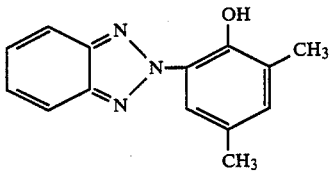
(I-3)

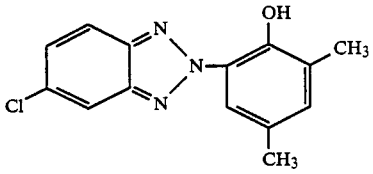
(I-4)

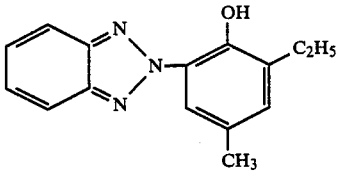
(I-5)

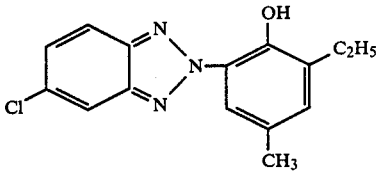
(I-6)

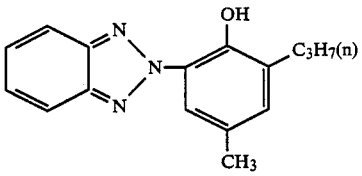
(I-7)

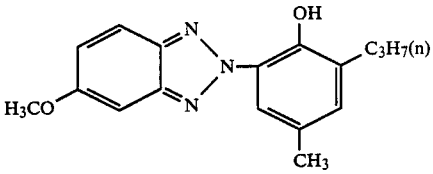
(I-8)

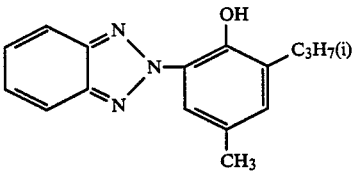
(I-9)

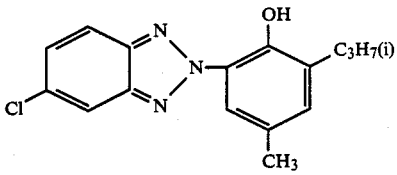
(I-10)

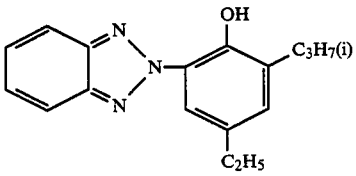
(I-11)

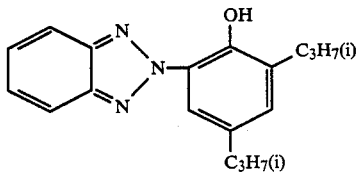
(I-12)

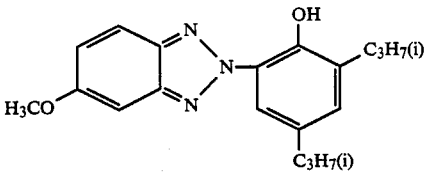
(I-13)

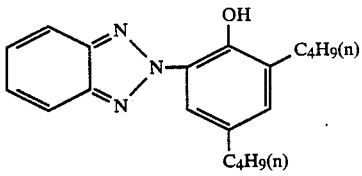
(I-14)

-continued
(I-15)
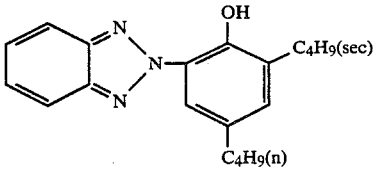
(I-16)
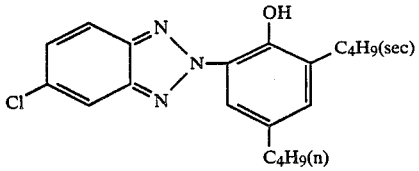
(I-17)
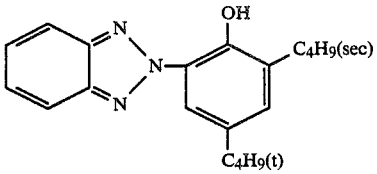
(I-18)
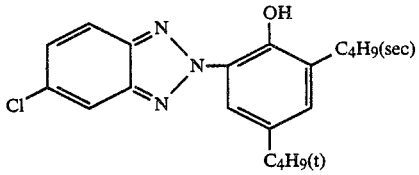
(I-19)
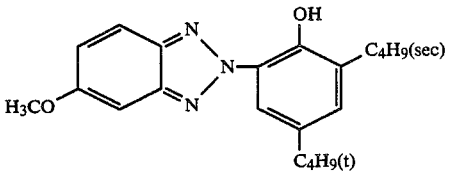
(I-20)
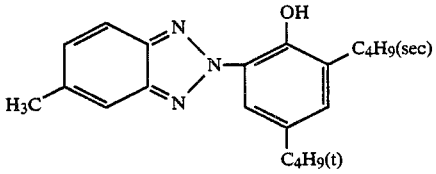
(I-21)
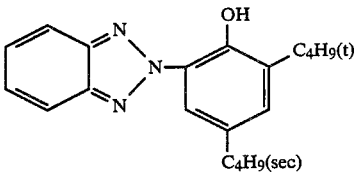
(I-22)
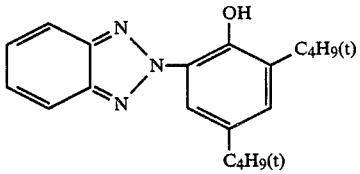
(I-23)
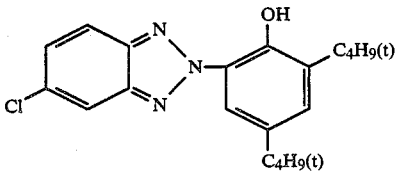
(I-24)
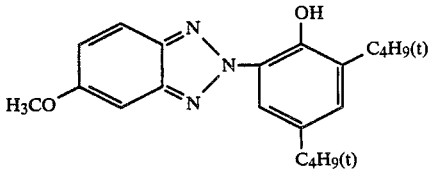
(I-25)
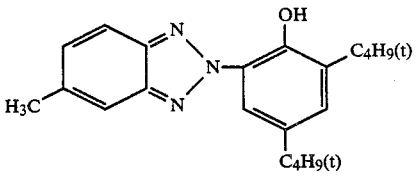
(I-26)
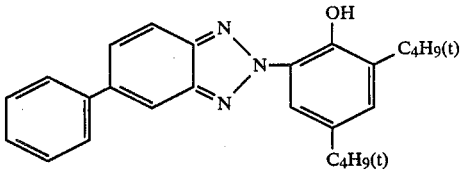
(I-27)
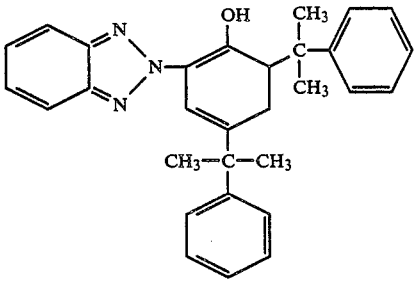
Examples of the UV absorber of formula (II):
(II-1)
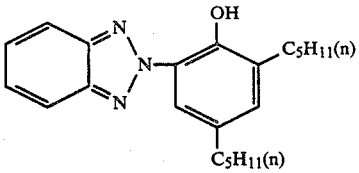
-continued
(II-2)
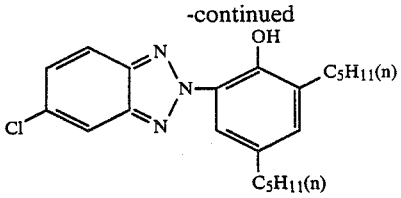

-continued
(II-3)
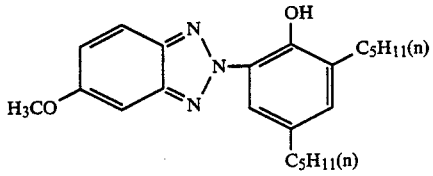
(II-4)
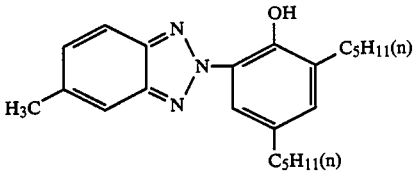
(II-5)
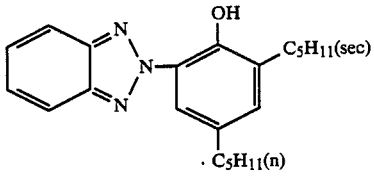
(II-6)
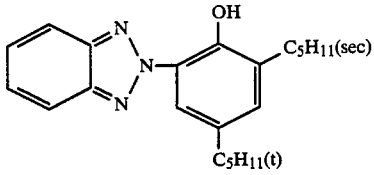
(II-7)
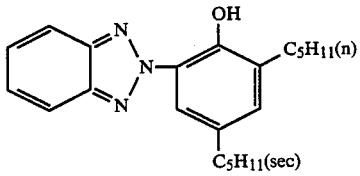
(II-8)
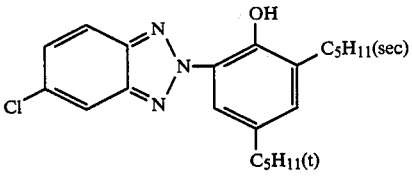
(II-9)
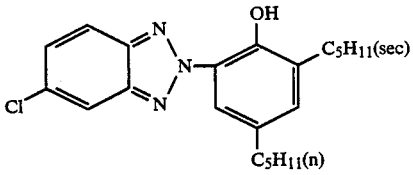
(II-10)
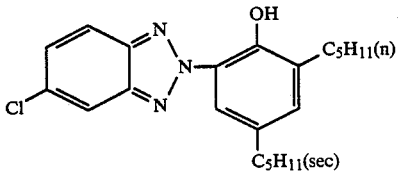
(II-11)
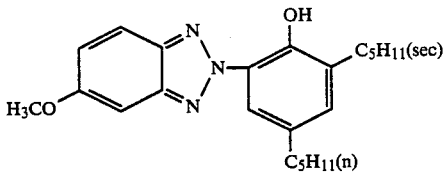
-continued
(II-12)
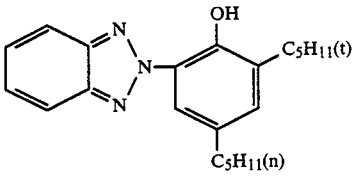
(II-13)
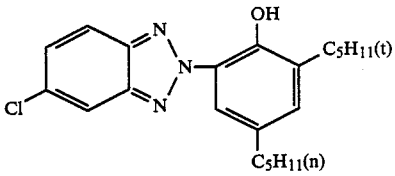
(II-14)
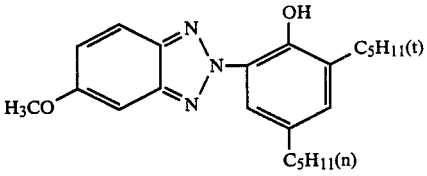
(II-15)
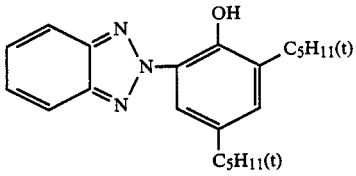
(II-16)
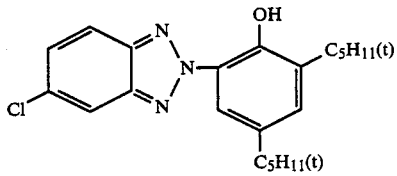
(II-17)
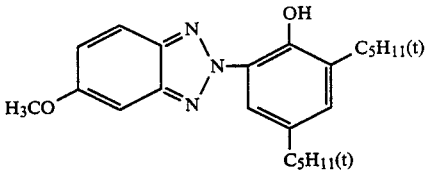
(II-18)
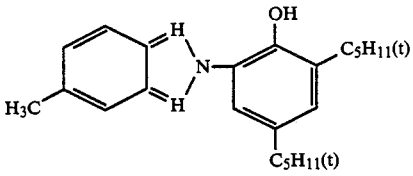
(II-19)
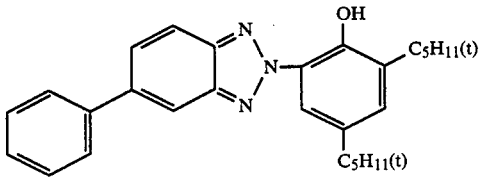
(II-20)
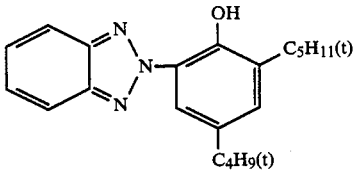

-continued (II-21)

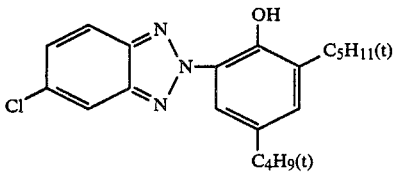

(II-22)

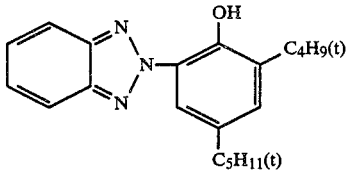

(II-23)

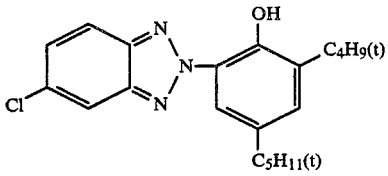

(II-24)

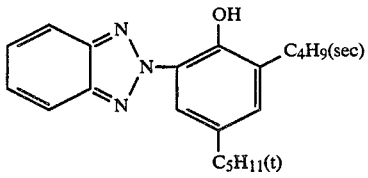

(II-25)

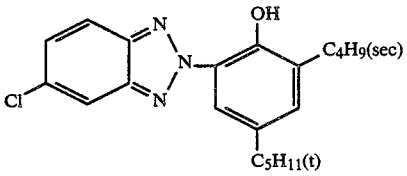

(II-26)

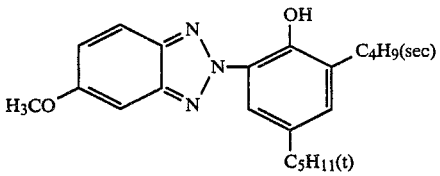

(II-27)

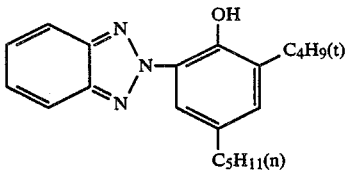

(II-28)

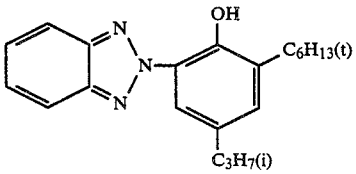

(II-29)

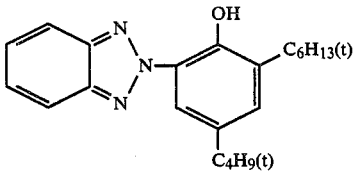

-continued (II-30)

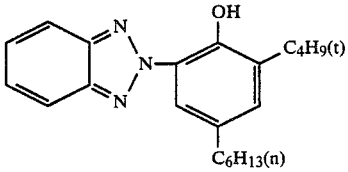

(II-31)

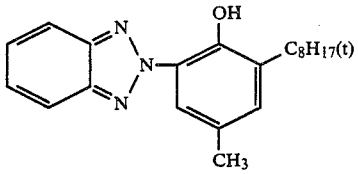

(II-32)

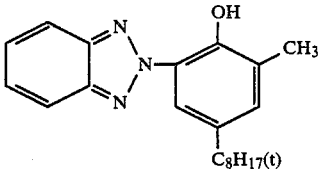

(II-33)

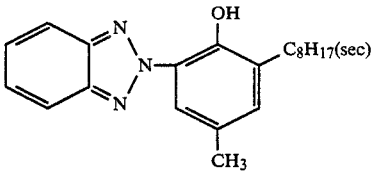

(II-34)

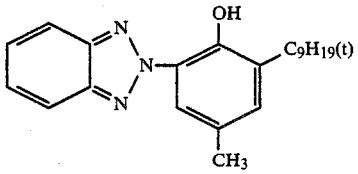

These UV absorbers are shown in various prior art references such as Japanese patent publication Nos. 10466/1961, 26,187/1967, 5,496/1973, 41,572/1973, 12,587/1980, and 36,984/1980; Japanese patent application (OPI) Nos. 85,425/1978 and 119,235/1979; and U.S. Pat. Nos. 3,754,919 and 4,220,711.

Preferred combinations of the compounds of formula (I) and those of formula (II) are shown in the following list.

| | Compounds of formula (I) | Compounds of formula (II) |
|---|---|---|
| 1 | I-12 | II-15 |
| 2 | I-15 | II-6 |
| 3 | I-17 | II-16 |
| 4 | I-22 | II-15 |
| 5 | I-23 | II-18 |
| 6 | I-24 | II-19 |
| 7 | I-25 | II-21 |
| 8 | I-22 | II-16 |
| 9 | I-17 | II-15 |
| 10 | I-12 | II-16 |
| 11 | I-2 | II-18 |
| 12 | I-1 | II-15 |
| 13 | I-10 | II-16 |
| 14 | I-9 | II-15 |
| 15 | I-2 | II-31 |
| 16 | I-22 | II-24 |

The dispersion of UV absorber according to the present invention may be prepared by any of the methods commonly employed in the photographic industry; for example, the dispersion may be prepared in accordance with the methods used to manufacture the color dispersions shown in U.S. Pat. Nos. 2,322,027, 2,801,170, 2,801,171, 2,870,012 and 2,991,177. More specifically, the two compounds shown in this specification are dissolved in a high-boiling organic solvent having a boiling point of about 175° C. or more, optionally in combination with a low-boiling organic solvent having a boiling point of about 150° C. or lower, and the resulting solution is finely dispersed in a hydrophilic binder such as an aqueous gelatin solution with the aid of a surfactant.

A suitable high-boiling organic solvent may be selected from among organic acid amides, carbamates, esters, ketones, higher alcohols and urea derivatives. The high-boiling organic solvents that can be preferably used in the present invention are represented by either of the following formulas (III) and (IV):

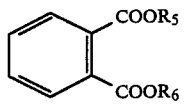

(III)

(wherein $R_5$ and $R_6$ each represents an alkyl group, an alkenyl group, a cycloalkyl group or an aryl group);

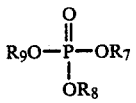

(IV)

(wherein $R_7$, $R_8$ and $R_9$ each represents an alkyl group, an alkenyl group, a cycloalkyl group or an aryl group).

In the formulas (III) and (IV), examples of the groups represented by $R_5$ to $R_9$ include an alkyl group (e.g. methyl, butyl, or octyl), an alkenyl group (e.g. vinyl, allyl or pentenyl), a cycloalkyl group (e.g. cyclopropyl cyclohexyl or cyclodecyl), and an aryl group (e.g. phenyl or tolyl). Among these examples, alkyl and aryl groups are preferred, and a branched alkyl group is particularly preferred. For providing a dispersion having high stability, an alkyl group having 8 to 16 carbon atoms gives the best results. Particularly preferred examples of the alkyl group include 2-ethylhexyl, isononyl, 3,5,5-trimethylhexyl, isodecyl, isoundecyl and isododecyl groups.

As compounds of formulas (III) and (IV), those wherein $R_5$ to $R_9$ each represents an alkyl group having 8 to 16 carbon atoms are particularly preferred because they promise a highly stable dispersion. Most preferred are compounds of formula (III) wherein $R_5$ and $R_6$ each represents an alkyl group having 8 to 16 carbon atoms since they provide a dispersion ensuring an extremely high storage stability under hot and humid conditions.

The compounds of formulas (III) and (IV) are illustrated by, but by no means limited to, the following specific examples.

Compounds of formula (III):
(HBS-1) Dibutyl phthalate
(HBS-2) Di-n-octyl phthalate
(HBS-3) Di-2-ethylhexyl phthalate
(HBS-4) Di-n-nonyl phthalate
(HBS-5) Di-i-nonyl phthalate
(HBS-6) Di-3,5,5-trimethylhexyl phthalate
(HBS-7) Diisodecyl phthalate
(HBS-8) Di-n-undecyl phthalate
(HBS-9) Di-i-undecyl phthalate
(HBS-10) Di-i-tridecyl phthalate
(HBS-11) Butyloctyl phthalate Compounds of formula (IV):
(HBS-11) Triphenyl phosphate
(HBS-12) Tricresyl phosphate
(HBS-13) n-Butyl-di-(2-ethylhexyl)phosphate
(HBS-14) Tri-(2-ethylhexyl)phosphate
(HBS-15) Triisononyl phosphate
(HBS-16) Tri-(3,5,5-trimethylhexyl)phosphate
(HBS-17) Tri-i-decyl phosphate
(HBS-18) Tri-n-decyl phosphate
(HBS-19) Tri-i-undecyl phosphate
(HBS-20) Tri-i-tridecyl phosphate Examples of the low-boiling organic solvent that may be used in combination with the high-boiling organic solvent include methyl acetate, ethyl acetate, propyl acetate, butyl acetate, butyl propionate, cyclohexanol, cyclohexane, tetrahydrofuran, methyl alcohol, ethyl alcohol acetonitrile, dimethylformamide, dioxane, methyl ethyl ketone, methyl isobutyl ketone, diethylene glycol monoacetate, acetyl acetone, nitromethane, nitroethane, carbon tetrachloride and chloroform.

Examples of the surfactant that is used as an emulsifier include anionic surfactants such as alkylbenzenesulfonates, alkylnaphthalenesulfonates, alkylsulfonates, alkylsulfate esters, alkylphosphate esters, sulfosuccinate esters, and sulfoalkylpolyoxyethylenealkyl phenyl ether; nonionic surfactants such as steroid saponins, alkylene oxide derivatives and glycidol derivatives; amphoteric surfactants such as amino acids, aminoalkylsulfonic acids and alkylbetaines; and cationic surfactants such as quaternary ammonium salts. Among these compounds, anionic and/or nonionic surfactants are preferred, and alkylbenzenesulfonates, alkylnaphthalenesulfonates and sulfosuccinate esters are particularly preferred.

Examples of the emulsifying or dispersing machine include a simple agitator, homogenizer, colloid mill, flow-jet mixer and anultrasonic disperser.

A specific method for preparing the dispersion of UV absorber according to the present invention is shown below. First, the compounds of formulas (I) and (II), as well as a high-boiling organic solvent and a low-boiling organic solvent are mixed under heating (ca. 60° C.) to form a solution. An aqueous gelatin clear solution is mixed with an emulsifier and the mixture is heated at ca. 60° C. to form a solution. The two solutions are mixed under agitation and the mixture is thereafter dispersed in a homogenizer or any other suitable dispersing machine.

The UV absorber composed of a mixture of the compounds of formulas (I) and (II) is contained in the resulting dispersion in an amount which ranges preferably from 1 to 200 wt%, more preferably from 10 to 100 wt%, of the gelatin. The high-boiling solvent is preferably used in an amount ranging from 10 to 300 wt%, more preferably from 30 to 100 wt%, of the UV absorber. The low-boiling solvent is preferably used in an amount of 50 to 1000 wt% of the UV absorber.

The dispersion according to the present invention may optionally contain a hydrophobic organic compound such as a UV absorber other than the compounds of formulas (I) and (II), an agent to prevent interlayer mixing, a color dye image forming coupler, a "DIR" coupler that releases a development inhibitor concurrently with the start of development, or a toner conditioner.

The dispersion according to the present invention may be applied to any type of the photographic element that has at least one dye image forming layer provided on a support. Such photographic element includes a non-silver salt light-sensitive material, but a silver halide photographic material is more preferred. Illustrative silver halide photographic materials include those which use dye image such as black-and white light-sensitive materials, color negative films, color papers, color reversal films, color films for motion pictures, and color diffusion transfer films. Silver halide color photographic materials usually comprise a support having formed thereon three light-sensitive silver halide emulsion layers selectively sensitized to lights of three different colors, ie, blue, green and red lights. Taking the example of a color negative film, a support is coated with a blue-sensitive emulsion layer (top and to be in contact with a light source for exposure), a green-sensitive emulsion layer and a red-sensitive emulsion layer. Usually, a bleachable yellow fiber is disposed as a non-sensitive layer between the blue- and green-sensitive layers for the purpose of absorbing blue light that has transmitted through the blue-sensitive layer. According to common practice, an intermediate layer is provided between each emulsion layer for achieving a special purpose, and a protective layer is provided as the outermost layer.

With a color paper, red-, green- and blue-sensitive emulsion layers are coated in this order, the red-sensitive layer being on the top and in contact with a light source for exposure; as in the case of a color negative film, the color paper is provided with non-sensitive layers such as a UV absorbing layer, an intermediate layer and a protective layer. Alternatively, the three light-sensitive emulsion layers may be arranged in a different order than stated above, or each emulsion layer may consist of two, rather than one, layer units.

In order to form dye images on these silver halide color photographic materials, they are first exposed, and then, the exposed silver halide grains are developed with a color developing agent such as an aromatic primary amine compound, causing the oxidized product of the developing agent to react with a dye-forming coupler to provide the desired dye images. Dye images of three different colors (ie, cyan, magenta and yellow) are usually formed, and for providing the respective images, a cyan coupler (made of a phenolic or naphtholic compound), a magenta coupler (made of a 5-pyrazolone, pyrazolinobenzimidazole, pyrazolotriazole, indazolone or cyanoacetyl compound) and a yellow coupler (made of an acylacetamide or benzoylmethane compound) are used.

Illustrative yellow couplers are shown in many prior art references such as U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322, 3,725,072, and 3,894,875; German Patent Applications (DE-OS) Nos. 1,547,868, 2,057,941, 2,162,899, 2,163,812, 2,213,461, 2,219,917, 2,261,361, and 2,263,875; Japanese Patent Publication No. 13,576/1974; Japanese Patent Applications (OPI) Nos. 29,432/1973, 66,834/1973, 10,736/1974, 122,335/1974, 28,834/1975 and 132,926/1975.

Illustrative magenta couplers are also shown in many prior art references such as U.S. Pat. Nos. 2,600,788, 3,061,432, 3,062,653, 3,127,269, 3,311,476, 3,152,896, 3,419,391, 3,519,429, 3,555,318, 3,684,514, 3,888,680, 3,907,571, 3,928,044, 3,930,861, 3,930,866, and 3,933,500; Japanese Patent Applications (OPI) Nos. 29,639/1974, 111,631/1974, 129,538/1974, 13,041/1975, 58,922/1977, 62,454/1980, 118,034/1980 and 38,043/1981; British Patent No. 1,247,493; Belgian Patent Nos. 769,116 and 792,525; German Patent (DE-PS) No. 2,156,111; and Japanese Patent Publication No. 60,479/1971.

Illustrative cyan couplers are also found in the literature such as U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763, 3,839,044, and 3,880,661; German Patents (DE-PS) Nos. 2,163,811 and 2,207,468; Japanese Patent Publications Nos. 27,563/1964 and 28,836/1970; Japanese Patent Applications (OPI) Nos. 37,425/1972, 10,135/1975, 25,228/1975, 112,038/1975, 117,422/1975, 130,441/1975, 109,630/1978, 65,134/1981 and 99,341/1981; and Research Disclosure No. 14,853 (1976).

These dye forming couplers are incorporated in either one or more of the light-sensitive color photographic emulsion layers, or within a developer. For the purpose of color-developing the respective dye image forming couplers incorporated in the photographic element, common color developing agents may be used without particular limitation, and useful examples are aromatic primary amine compounds such as primary phenylenediamines, aminophenols and their derivatives. Typical examples of such aromatic primary amine compounds are listed below.

N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetylamino-4-aminodimethylaniline, N-ethyl-N-$\beta$-methanesulfonamidoethyl-4-aminoaniline, N-ethyl-N-$\beta$-methanesulfonamidoethyl-3-methyl-4-aminoaniline, N-methyl-N-$\beta$-sulfoethyl-p-phenylenediamine, o-aminophenol, p-aminophenol, and 5-amino-2-oxy-toluene, as well as their salts with inorganic acids (e.g. hydrochloric acid and sulfuric acid) or organic acids (e.g. p-toluenesulfonic acid).

When incorporated in a silver halide color photographic material, the couplers listed above are used generally in an amount of 5 to 50 mol%, preferably from 10 to 45 mol%, of the silver halide. When present in the developer, the couplers are used in an amount generally ranging from 0.5 to 3.0 g/1,000 ml, preferably from 1.0 to 2.0 g/1,000 ml. The yellow, magenta and cyan couplers may be used either alone or in combination, and in the latter case, the total amount of the combined couplers need be within the ranges defined above.

The silver halide color photographic material to which the dispersion of the present invention can be applied may optionally contain other types of couplers (e.g. colored magenta coupler) for achieving special purposes (e.g. masking). One or more of the silver halide color photographic emulsion layers or layers adjacent thereto may contain a coupler that releases a development inhibitor during development in an amount depending upon the density of the image formed, or a DIR compound other than couplers. One or more hydroquinone derivatives may be used as antioxidants. For a coupler-containing silver halide color photographic material, these anti-oxidants are preferably used in an amount of 0.001 to 10 mols, more preferably from 0.01 to 3 mols, per mol of the coupler. For a silver halide color photographic material containing no coupler, the antioxidants may preferably be used in an amount of 0.001 to 1.0 mol, more preferably from 0.02 to 0.6 mol, per mol of the silver halide.

The silver halide emulsions employed in the photographic element to which the dispersion of the present invention can be applied are each comprised of a hydrophilic colloid having silver halide grains dispersed therein. Suitable silver halides are silver chloride, silver bromide, silver iodide, silver chlorobromide, silver iodobromide, silver chloroiodobromide, and mixtures thereof. These silver halides may be prepared by various techniques such as the ammoniacal method, neutral method, conversion method and the double-jet method.

Hydrophilic colloids commonly used to disperse these silver halides are gelatin and its derivatives such as phthalylated gelatin and malonylated gelatin. All or part of the gelatin or its derivatives may be replaced by albumin, agar, gum arabic, alginic acid, casein, partially hydrolyzed cellulose derivatives, partially hydrolyzed poly(vinyl acetate), polyacrylamide, imidated polyacrylamide, polyvinyl pyrrolidone or copolymers of these vinyl compounds.

The silver halide emulsions used with the present invention may be spectrally sensitized with various sensitizing dyes to provide sensitivity to the desired wavelength ranges. Suitable sensitizing dyes are cyanine dyes, merocyanine dyes and composite cyanine dyes, which may be used either alone or in combination.

Other photographic additives that may be combined the silver halide emulsions include chemical sensitizers such as salts of noble metals (e.g. gold compounds, platinum, palladium, iridium, rhodium and ruthenium), sulfur compounds, reductive materials or thioether compounds, quaternary ammonium chlorides and polyalkylene oxide compounds; stabilizers such as triazoles, imidazoles, azaindenes, benzothiazolium salts, zinc compounds, cadmium compounds and mercaptans; hardeners such as chromium salts, zirconium salts, mucochloric acids, aldehyde compounds, triazine compounds, polyepoxy compounds, active halogen compounds, ketone compounds, acryloyl compounds, triethylenephosphamide compounds and ethyleneimine compounds; plasticizers such as glycerin and dihydroxyalkanes (e.g. 1,5-pentanediol); brighteners; antistatic agents; and coating aids. These photographic additives may be used either alone or in combination.

The dispersion of UV absorber according to the present invention is incorporated in one or more layers selected from among the silver halide emulsion layers, subbing layer, antihalation layer, intermediate layers, yellow filter layer and protective layer. The so treated dispersion is then applied to a photographic support in the form of a synthetic resin film made of acetylcellulose, nitrocellulose, polycarbonate, polyethylene terephthalate or polyethylene, baryta paper, polyethylene-coated paper or glass sheet.

The resulting silver halide color photographic material may be of the coupler-in-emulsion type or coupler-in-developer type, with the former type being particularly preferred. Either type of the photographic material is first exposed and color developed by a known method. Alternatively, both a coupler and a color developing agent are incorporated in the same layer in such a manner that they are protected from mutual contact before exposure and are brought into contact only after exposure. In another possible arrangement of a coupler-containing silver halide color photographic material, a color developing agent is incorporated in a coupler-free layer in such a manner that, upon penetration of an alkaline processing solution, said agent is caused to move upon into contact with the coupler in another layer.

According to the reversal method, the photographic material is first developed with a black-and-white developer, and then, is given an exposure to white light or treated with a bath containing a fogging agent such as a boron compound, and subsequently, color developed with an alkaline developer containing a color developing agent. The alkaline developer may incorporate a fogging agent.

After the color development, the photographic material is treated with a bleaching solution containing a ferricyanide or a ferric salt of aminopolycarboxylic acid. Subsequently, the material is treated with a fixing solution containing a silver salt solvent such as thiosulfate, so as to remove the silver image and residual silver halide and leave only the dye image.

Instead of using separate bleaching and fixing solutions, a bleach-fixing solution containing both an oxidizing agent such as a ferric salt of aminopolycarboxylic acid and a silver salt solvent such as thiosulfate may be used.

The color development, bleaching and fixing or bleach-fixing may be combined with various steps such as prehardening, neutralization, washing, stopping and stabilization. A processing protocol particularly suitable for use with the silver halide color photographic material containing the dispersion of UV absorber according to the present invention consists of color development, washing (optional), bleach-fixing, washing, stabilization (optional), and drying steps. The entire processing is performed at elevated temperatures ($\geqq 30°$ C.) and is completed within a very short period of time.

The color developer may optionally contain certain additives as well as the color developing agent. Typical additives include alkali agents such as hydroxides, carbonates and phosphates of alkali metals or ammonium; buffers such as acetic acid and boric acid; pH control agents; development accelerators; antifoggants; antistain or sludge agents; interlayer effect accelerators; and preservatives.

Examples of the bleaching agent include ferricyanides (e.g. potassium ferricyanide), bichromates, permanganic acid, hydrogen peroxide, bleaching powder, metal complex salts of aminopolycarboxylic acids (e.g. ethylenediaminetetraacetic acid, nitrilotiracetic acid and iminodiacetic acid), metal complex salts of polycarboxylic acids (e.g. malonic acid, tartaric acid and malic acid), and ferric chloride. These compounds may be used either independently or in combination. The bleaching solution may also contain a bleaching accelerator and several other additives.

Examples of the fixing agent include thiosulfates (e.g. sodium thiosulfate and ammonium thiosulfate), cyanides, and urea derivatives. The fixing solution may also contain a fixing accelerator and several other additives.

The silver halide color photographic material using the dispersion of UV absorber according to the present invention may also be processed, with equally good results, by a color developing solution containing both an aromatic primary amine color developing agent and an oxidizing agent that brings the metallic silver image into a Redox reaction.

The dispersion of UV absorber according to the present invention may also be incorporated in the light-sensitive element and/or image-receiving element of a silver halide color diffusion transfer photographic material. Advantageously, the dispersion is incorporated in the image-receiving element. In this case, a suitable dye image forming material may be selected from among the many known compounds, which are described in the following literature: U.S. Pat. Nos. 3,227,550, 3,880,658, 3,765,886, 3,443,940, 3,751,406, 3,725,062, 3,698,897, 3,728,113, 3,928,312, 3,993,638, 3,932,380, 3,932,381, 3,931,144, 3,929,760, and 3,942,987; British Pat. Nos. 904,364, 904,365 and 1,038,331; French Pat. No. 2,284,140; Japanese Patent Applications (OPI) Nos. 123,032/1974, 104,343/1976, 113,624/1976, 109,928/1976, 7,727/1977 and 8,827/1977; and Research Disclosure Vol. 130 (1975) No. 13024 and Vol. 151 (1976) No. 15157.

A photographic product containing the dispersion of UV absorber according to the present invention exhibits an extremely high storage stability under hot and humid conditions. Further, the product experiences a minimum amount of light stain under such hostile conditions. The stability of the dispersion per se is very high.

The advantages of the present invention will become apparent by reading the following non-limiting examples.

EXAMPLE 1

In order to check the stability of the dispersion of UV absorber according to the present invention, as well as the storage stability of a photographic coat incorporating that dispersion, dispersion samples having the formulations shown in Table 1 were prepared.

TABLE 1

| Sample No. | Composition of UV absorber | High-boiling solvent | Remarks |
|---|---|---|---|
| 1 | (UV-1):(I-2):(I:22):(I-23) = 2:1:1:1 | (HBS-1) | the mixture shown in Experiment 3 of Japanese Patent Publication No. 5496/1973 |
| 2 | (UV-2):(UV-3):(UV-4):(UV-5) = 1:1:1:1 | (HBS-1) | shown in Ex. 2 of Japanese Patent Publication No. 41,572/1973 |
| 3 | (UV-2):(UV-6) = 2:1 | (HBS-1) | shown in Ex. 3 of Japanese Patent Publication No. 30,493/1973 |
| 4 | (UV-1):(II-15) = 30:70 | (HBS-1) | shown in Ex. 1 of Japanese Patent Application (OPI) No. 85,425/1978 |
| 5A | (I-22):(II-15) = | (HBS-1) | sample of the present |
| 5B | 25:75 | (HBS-3) | invention |
| 6 | (I-23):(II-15) = 25:75 | (HBS-3) | sample of the present invention |
| 7 | (I-2):(II-15) = 25:75 | (HBS-3) | sample of the present invention |
| 8 | (I-17):(II-16) = 25:75 | (HBS-3) | sample of the present invention |
| 9 | (I-22):(II-6) = 25:75 | (HBS-3) | sample of the present invention |
| 10 | (I-22):(II-16) = 25:75 | (HBS-3) | sample of the present invention |

The UV absorbers (UV-1 to UV-6) used for the purpose of comparison had the following chemical formulas:

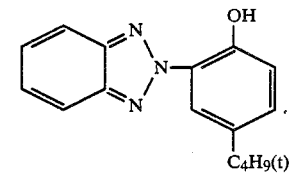

(UV-1)

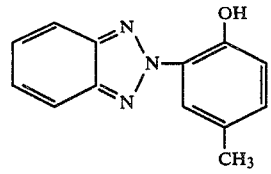

(UV-2)

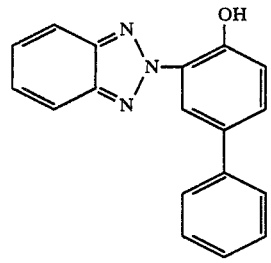

(UV-3)

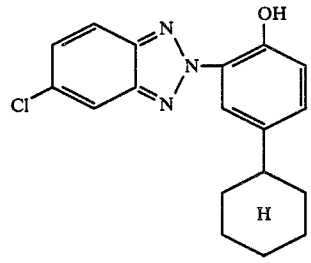

(UV-4)

-continued

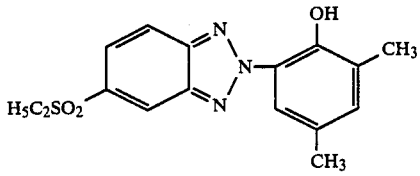

(UV-5)

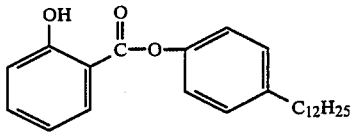

(UV-6)

Dispersions of the respective UV absorber compositions shown in Table 1 were prepared by the following procedure.

(a) The UV absorber compositions (10 g) dissolved in either HBS-1 or HBS-3 (10 g) were mixed with 20 g of ethyl acetate, and the respective mixtures were heated at about 60° C. to form solutions.

(b) Photographic gelatin (15 g) was mixed with pure water (200 ml) at room temperature, and the mixture was held at that temperature for 20 minutes to cause sufficient swelling. The mixture was then heated at about 60° C. to form a solution, which was combined with 20 ml of a 5% aqueous solution of Alkanol B of E. I. du Pont de Nemours under thorough agitation.

(c) The solution prepared in (a) was mixed with the solution prepared in (b), and the mixture was treated with an ultrasonic disperser for 20 minutes to obtain a uniform dispersion. It was then worked up with pure water to make 300 ml.

By the same procedure, eleven samples of the dispersion of UV absorber were prepared. Each sample dispersion was subjected to the following tests.

(1) Dispersion Stability Test

The vessel containing each sample was stoppered and exposed to 40° C. for 48 hours. The resulting increase in the turbidity (ΔT) of each sample, as well as the degree of crystallization in the dispersion were checked.

The results are shown in Table 2.

The "turbidity" is correlated with the size of dispersed particles, and under given conditions, smaller values of turbidity (ΔT) indicate smaller particle sizes (ie, the dispersed particles remained stable without becoming coarse). For the measurement of turbidity, a POIC sphere method turbidimeter, Model SEP-PT-501D of Nippon Precision Optical Instrument Co., Ltd. was used. The degree of crystallization in dispersed particles was determined by the following procedure: 100 ml of a sample dispersion was diluted with 100 ml of warm water and the resulting dilution was subjected to suction filtration on filter paper (No. 5A of Toyo Roshi Kaisha Ltd.), washed dried and checked for the weight of the crystal.

(2) Test for the Storage Stability of Dispersion in Coating

Eleven film samples having the layer arrangement shown in (i) below were prepared and subjected to a storage stability test under the conditions indicated in (ii).

(i) Layer arrangement

| | Gelatin deposit (mg/100 cm$^2$) | UV absorber | High-boiling solvent |
|---|---|---|---|
| Protective layer | 10 | — | — |
| UV absorber containing layer | 20 | 2.0 (For composition, see Table 1) | 2.0 (HBS-6) |
| Triacetyl cellulose film support | | | |

(ii) Test conditions

| | |
|---|---|
| A. Xenon fadeometer exposure | 400 hr |
| B. Stored at 70° C. under dry conditions | one wk |
| C. Stored at 70° C. and 80% R.H. | one wk |

The UV absorption spectrum of each sample was taken both before and after its storage, and the ratio of absorbance at maximum absorption wavelength of the virgin sample to that for the stored sample was used as in index for its storage stability. The results are shown in Table 2.

TABLE 2

| Sample No. | Stability of dispersion ΔT | Stability of dispersion Crystal weight (mg) | Storage stability in coating A | B | C | Remarks |
|---|---|---|---|---|---|---|
| 1 | 139 | 21 | 84 | 94 | 40 | Comparative sample |
| 2 | 162 | 25 | 85 | 96 | 45 | Comparative sample |
| 3 | 127 | 18 | 79 | 95 | 41 | Comparative sample |
| 4 | 116 | 19 | 80 | 94 | 43 | Comparative sample |
| 5A | 96 | 14 | 89 | 97 | 62 | Sample of the present invention |
| 5B | 75 | 10 | 89 | 97 | 75 | Sample of the present invention |
| 6 | 78 | 11 | S9 | 96 | 75 | Sample of the present invention |
| 7 | 89 | 14 | 89 | 96 | 60 | Sample of the present invention |
| 8 | 77 | 11 | 89 | 96 | 75 | Sample of the present invention |
| 9 | 76 | 10 | 89 | 96 | 74 | Sample of the present invention |
| 10 | 76 | 11 | 89 | 96 | 75 | Sample of the present invention |

The above data shows that while all samples had a relatively high stability, the dispersions according to the present invention were much more stable than the conventional samples. The samples tested behaved in a very different manner from each other with respect to the storage stability in coating. Samples 1 to 4 of the prior art had a particularly low stability under hot and humid conditions (C). Both samples 1 and 4 were outside the scope of the present invention because the former contained a compound of formula (I) but did not contain a compound of formula (II), whereas the latter did not contain a compound of formula (I). Only samples 5 to 10 according to the present invention which contained both compounds of formulas (I) and (II) at specific ratios exhibited an extremely high level of stability during the storage under hot and humid conditions, and among these samples, those numbered 5B, 6 and 8 to 10 provided particularly good results. Samples 5 to 10 of the present invention were slightly improved over the conventional products with respect to light fastness (condition A) and heat resistance (condition B). Therefore, with all factors considered, the samples of the present invention proved to have a remarkably improved stability in coat.

EXAMPLE 2

The good characteristics of the dispersion of UV absorber according to the present invention do not depend on the type of the high-boiling organic solvent used. In order to show this fact, the procedure of Example 1 was repeated with samples having the same composition of UV absorber as that of Sample 5 but which used different high-boiling solvents as shown in the following table. The results are also shown in the same table.

| | High-boiling solvent | Stability of dispersion | | Storage stability in coating | | |
|---|---|---|---|---|---|---|
| | | ΔT | Crystal weight (mg) | A | B | C |
| 1 | (HBS-1) | 96 | 14 | 89 | 97 | 62 |
| 2 | (HBS-3) | 75 | 10 | 89 | 97 | 75 |
| 3 | (HBS-6) | 70 | 10 | 89 | 97 | 75 |
| 4 | (HBS-12) | 102 | 15 | 88 | 96 | 61 |
| 5 | (HBS-14) | 78 | 12 | 89 | 97 | 64 |
| 6 | (HBS-16) | 76 | 11 | 89 | 97 | 63 |
| 7 | n-butylcarbitol acetate | 112 | 15 | 88 | 95 | 62 |
| 8 | N,N—diethyl-lauryl amide | 109 | 14 | 88 | 96 | 64 |

As one can see by comparing the above data with Table 2, the superiority of the dispersion of the present invention over the conventional samples used in Example 1 was not lost whichever type of high-boiling organic solvents was used.

EXAMPLE 3

In order to the show the criticality of the mixing ratio of the compounds of formulas (I) and (II), the procedure of Example 1 was repeated with Sample 5 by changing the mixing ratio of the two compounds as shown in Table 3 below. The results are also shown in the same Table.

TABLE 3

| Sample No. | Composition of UV absorber | Stability of dispersion | | Storage stability in coating | | | Remarks |
|---|---|---|---|---|---|---|---|
| | | ΔT | Crystal weight (mg) | A | B | C | |
| 1 | (I-22):(II-15) = 100:0 | 223 | 826 | 82 | 94 | 31 | Comparative sample |
| 2 | (I-22):(II-15) = 83.3:16.7 | 168 | 563 | 82 | 94 | 35 | Comparative sample |
| 3 | (I-22):(II-15) = 66.7:33.3 | 163 | 491 | 83 | 95 | 39 | Comparative sample |
| 4 | (I-22):(II-15) = 50:50 | 160 | 477 | 84 | 94 | 43 | Comparative sample |
| 5 | (I-22):(II-15) = 33.3:66.7 | 78 | 11 | 88 | 96 | 74 | Sample of the present invention |
| 6 | (I-22):(II-15) = 16.7:83.3 | 74 | 10 | 89 | 96 | 75 | Sample of the present invention |
| 7 | (I-22):(II-15) = 0:100 | 210 | 375 | 84 | 95 | 55 | Comparative sample |

The data in Table 3 shows that only when the compounds of formulas (I) and (II) were mixed at the ratios specified in the present invention could the desired improvement in the stability of the dispersion of UV absorber and its storage stability in coating be ensured.

EXAMPLE 4

Samples of the dispersion of UV absorber according to the present invention were incorporated in a color photographic paper and an experiment was conducted to show how the good storage stability of the UV absorber lent itself to preventing light-induced discoloration of color-forming dyes.

Color photographic paper samples having the layer arrangement shown below were prepared, with the composition of a UV absorber being changed as indicated in Table 1 associated with Example 1.

| Layer No. | Layer name | Silver deposit | Gelatin deposit | Coupler | Dye image stabilizer | UV absorber | Anti-interlayer mixing agent | High-boiling solvent |
|---|---|---|---|---|---|---|---|---|
| 7 | protective layer | — | 10 | — | — | — | — | — |
| 6 | 3rd intermediate layer | — | 10 | — | — | (For composition, see Table 1) 4.0 | (D) 0.67 | (HBS-6) 3.0 |
| 5 | red-sensitive emulsion layer | 3.0 | 20 | (A) 6.0 | (E) 3.0 | — | (D) 0.10 | (HBS-3) 4.2 |
| 4 | 2nd intermediate layer | — | 15 | — | — | (For composition, see Table 1) 6.0 | (D) 1.0 | (HBS-6) 5.0 |
| 3 | green-sensitive | 3.0 | 20 | (B) 6.1 | (F) 3.0 (G) 2.0 | — | (D) 0.20 | (HBS-3) 5.0 |

-continued

| Layer No. | Layer name | Silver deposit | Gelatin deposit | Coupler | Dye image stabilizer | UV absorber | Anti-interlayer mixing agent | High-boiling solvent |
|---|---|---|---|---|---|---|---|---|
| | emulsion layer | | | | | | | |
| 2 | 1st intermediate layer | — | 5 | — | — | — | (D) 1.0 | (HBS-6) 1.0 |
| 1 | blue-sensitive emulsion layer | 4.0 | 20 | (C) 10.0 | (E) 5.0 | — | (D) 0.20 | (HBS-6) 6.0 |
| | | | | Polyethylene coated paper | | | | |

Couplers (A), (B) and (C), anti-color mixing agent (D), as well as dye image stabilizers (E), (F) and (G) had the following chemical structures. The figures in each column of the above table denote the amount of a specific component in milligrams/100 $cm^2$.

By the above procedure, six samples of color photographic paper were prepared and given numbers 1, 2, 3, 4, 5B, 6 and 7 which corresponded to the numbers assigned to the respective dispersion samples prepared in Example 1. Six more samples were duplicated. One Coupler A

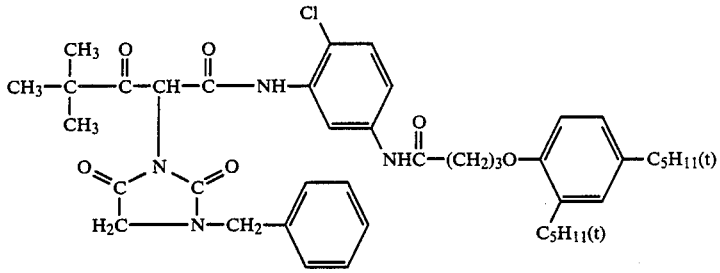

Coupler B

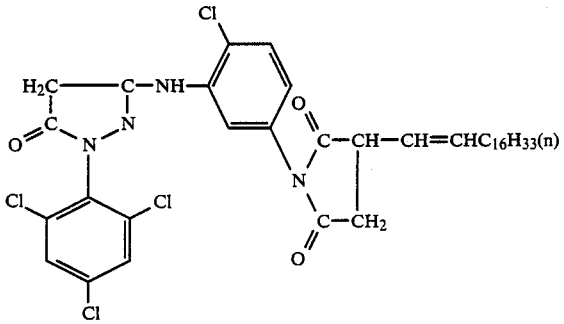

Coupler C

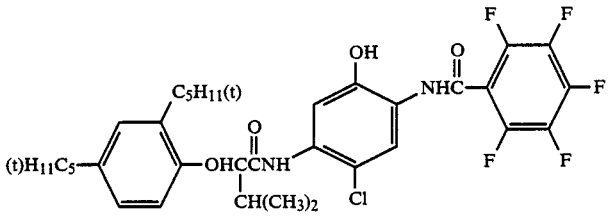

Anti-interlayer mixing agent D

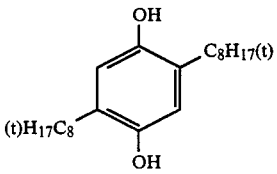

Dye image stabilizer E

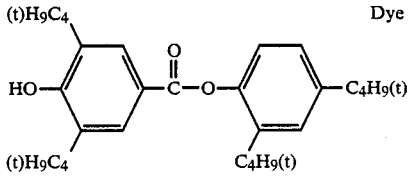

Dye image stabilizer F

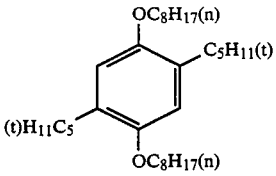

Dye image stabilizer G

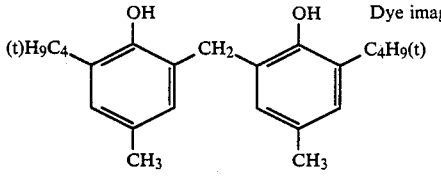

group of the samples were immediately processed (without exposure) according to the following protocol, thereby providing uncolored images. The other group of samples were exposed through an optical wedge to three different colors (blue, green and red) on a sensitometer (Model KS-7 of Konishiroku Photo Industry Co., Ltd.) and subsequently processed by the same protocol so as to provide images each having three color separation (yellow, magenta and cyan).

| Protocol | Time (min.) | Temperature (°C.) |
|---|---|---|
| Color development | 3.5 | 33 |
| Bleach-fixing | 1.5 | 33 |
| Washing | 3.0 | 33 |
| Drying | — | 80 |

| Components | Amount |
|---|---|
| Composition of color developer | |
| Pure water | 700 ml |
| Benzyl alcohol | 15 ml |
| Diethylene glycol | 15 ml |
| Hydroxylamine sulfate | 2 g |
| N—ethyl-N—β-methanesulfoneamido-ethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2 g |
| Pure water to make | 1,000 ml (pH = 10.2) |
| Composition of bleach-fixing solution | |
| Ethylenediaminetetraacetic acid iron ammonium | 61 g |
| Ethylenediaminetetraacetic acid diammonium | 5 g |
| Ammonium thiosulfate | 125 g |
| Sodium metabisulfite | 13 g |
| Sodium sulfite | 2.7 g |
| Water to make | 1,000 ml (pH = 7.2) |

The respective samples were subjected to a fading test with a xenon lamp under two different conditions, 30° C.×20% R.H. and 50° C.×80% R.H. for the purpose of evaluating their light fastness and the amount of light stain. A measure for the light fastness was the percent residual dye, or the relative value of the reflection density after exposure to xenon lamp, with the value before the exposure being taken as 1.0 times 100. For samples (especially yellow-colored samples) where the yellowing (light stain) of the white background due to exposure was not negligible, that change was allowed for in determining the reflection density after the exposure. For example, if an unexposed sample having a density of 0.00 in the white background and a yellow dye density of 1.00 changes to respective values of 0.18 and 0.78 after exposure to a xenon lamp, the percent residual dye is $(0.78-0.18)/1.00\times 100=60\%$.

The density of the white background of each sample after exposure to the xenon lamp was used as an index of light stain. In the example shown above, the amount of light stain is 0.18. The results are shown in Table 4 below, wherein the relative value of the amount of light stain in each sample is also indicated, with the value for comparative sample 1 being taken as 100.

TABLE 4

| | Exposed to Xenon Fadeometer for 400 Hrs | | | | | | | | | |
|---|---|---|---|---|---|---|---|---|---|---|
| | Exposure conditions | | | | | | | | | |
| | 30° C. × 20% R.H. | | | | | 50° C. × 80% R.H. | | | | |
| Sample No. | yellow | magenta | cyan | light stain | light stain in relative value | yellow | magenta | cyan | light stain | light stain in relative value |
| 1. Comparative sample | 62 | 59 | 81 | 0.15 | 100 | 47 | 43 | 70 | 0.17 | 100 |
| 2. Comparative sample | 62 | 60 | 80 | 0.14 | 93 | 47 | 44 | 68 | 0.16 | 94 |
| 3. Comparative sample | 60 | 59 | 79 | 0.14 | 93 | 44 | 43 | 66 | 0.17 | 100 |
| 4. Comparative sample | 61 | 59 | 80 | 0.14 | 93 | 45 | 42 | 68 | 0.17 | 100 |
| 5B. Sample of the present invention | 64 | 61 | 83 | 0.10 | 67 | 63 | 61 | 81 | 0.10 | 59 |
| 6. Sample of the present invention | 64 | 62 | 83 | 0.12 | 80 | 63 | 62 | 81 | 0.12 | 71 |
| 7. Sample of the present invention | 64 | 62 | 83 | 0.13 | 87 | 57 | 58 | 73 | 0.14 | 82 |

As Table 4 shows, samples 1 to 4 using the prior art dispersions of UV absorber experienced increased fading and light stain in the three dyes (yellow, magenta and cyan) under hot and humid conditions. This will be because the UV absorbers had low stability and gradually lost their ability to absorb UV radiation.

However, samples 5B to 7 using the dispersions of UV absorber according to the present invention experienced hardly any change in the color of each dye whether they were stored under hot and humid conditions or under normal-temperature and low-humidity conditions. This will be due to the extremely high stability of the UV absorber in coating. The amount of stain caused in samples 5B to 7 was much smaller than in the comparative samples not only under hot and humid conditions but also under normal-temperature and low-humidity conditions. This again shows their great ability to absorb UV radiation. Among the three samples of the present invention, sample 5B was particularly effective in minimizing the amount of light stain.

EXAMPLE 5

For the same purpose as shown in Example 5, samples of color diffusion transfer material were prepared using the dispersion of UV absorber according to the present invention. The procedures for their preparation were as follows.

(1) Preparation of light-sensitive element

An opaque poly(ethylene terephthalate) film base was coated with the following layers in the order written.

(1) polymeric acid layer
(2) timing layer
(3) cyan DRR compound
(4) red-sensitive, negative acting silver halide emulsion layer
(5) intermediate layer containing a developing agent
(6) magenta DRR compound
(7) green-sensitive, negative acting silver halide emulsion layer
(8) intermediate layer containing a developing agent
(9) yellow-ORR compound
(10) blue-sensitive, negative acting silver halide emulsion layer
(11) nonglossy protective layer.

The polymeric acid layer and timing layer are shown in Research Disclosure, vol. 184, No. 18,452, pp. 431–432, August 1979. The three DRR compounds are identified below. The developing agent incorporated in each intermediate layer was 1-phenyl-3-pyrazolidinone blocked at 3-position. The nonglossy protective layer consisted of gelatin (8.9 mg/100 $cm^2$), methacrylate beads (2–4μ, 0.17 mg/100 $cm^2$), silica particles of Ludox AM ® (ca. 0.2μ, 4.5 mg/100 $cm^2$) and 2,5-didodecylhydroquinone (38 mg/100 $cm^2$).

Layers 3 to 11 had a total of gelatin deposit of 81 mg/100 $cm^2$ and were hardened with 0.75% bis(vinylsulfonylmethyl ether.

(2) Preparation of image-receiving element

An opaque paper base was coated with the following layers in the order written:

(1) Image-receiving layer made of poly-1-vinyl-2-methylimidazole (32 mg/100 $cm^2$), gelatin (11 mg/100 $cm^2$), sorbitol (2.7 mg/100 $cm^2$) and formaldehyde (0.5 mg/100 $cm^2$).

(2) Intermediate layer made of gelatin (8.6 mg/100 $cm^2$), UV absorber (5.4 mg/100 $cm^2$), high-boiling organic solvent (3.2 mg/100 $cm^2$) and formaldehyde (0.5 mg/100 $cm^2$).

(3) Protective layer of gelatin (6.5 mg/100 $cm^2$).

(3) Preparation of activating solution

An activating solution of the following formulation was prepared:

| Components | Amount |
|---|---|
| Potassium hydroxide | 0.6 N |
| 5-Methylbenzotriazole | 3.0 g/1,000 ml |
| 11-Aminoundecanoic acid | 2.0 g/1,000 ml |
| Potassium bromide | 2.0 g/1,000 ml |

Five samples of image-receiving element for use in color diffusion transfer materials were prepared by changing the types of UV absorber and high-boiling organic solvent in layer (2) as specified in Table 5 below.

TABLE 5

| Sample No. | Composition of UV absorber | | High-boiling organic solvent |
|---|---|---|---|
| 1 (Comparative sample) | (II-15) | 5.40 | (HBS-1) |
| 2 (Comparative) | (UV-1) | 2.70 | (HBS-16) |

TABLE 5-continued

| Sample No. | Composition of UV absorber | | High-boiling organic solvent |
|---|---|---|---|
| | (I-17) | 2.70 | |
| | (I-23) | 1.08 | |
| 3 (Comparative) | (UV-1) | 1.62 | (HBS-6) |
| | (II-15) | 3.78 | |
| 4 (Sample of the present invention) | (I-25 | 1.35 | (HBS-6) |
| | (II-16) | 4.05 | |
| 5 (Sample of the present invention) | (I-22) | 1.08 | (HBS-16) |
| | (II-15) | 4.32 | |

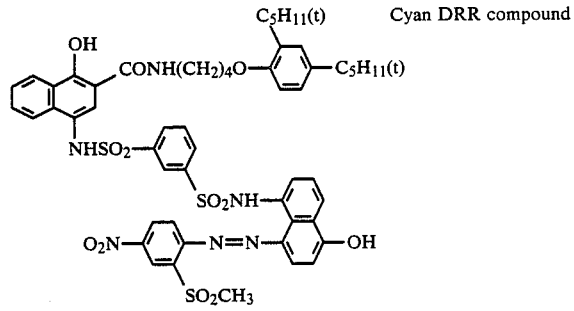

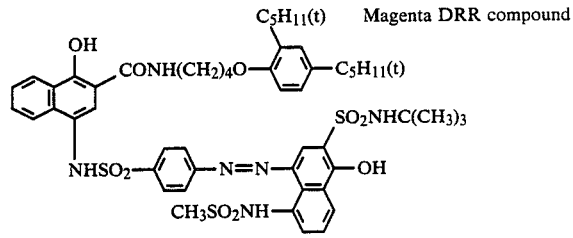

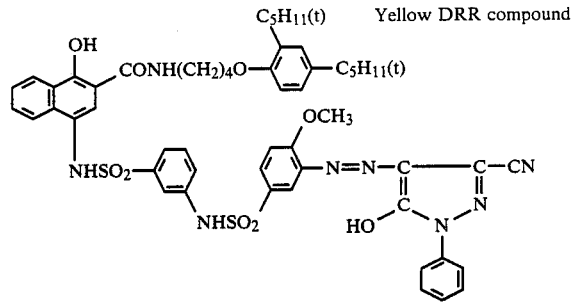

The light-sensitive element was rinsed, with or without exposure as in Example 4, with the activating solution for 15 seconds at 28° C., and passed between nip rollers to place the element on each image-receiving element. Ten minutes later, the image-receiving element was separated from the light-sensitive element. The image-receiving layer having neither a three color separation (yellow, magenta and cyan) or a white background was subjected to a fading test as in Example 4, except that each sample was exposed to sunlight for 240 days in a desiccator controlled at a relative humidity of either 10% or 81%. The light fastness of each dye and the amount of light stain in each sample are shown in Table 6 together with the surface gloss of each sample.

TABLE 6

| | Exposed to sunlight for 40 days | | | | | | | | |
|---|---|---|---|---|---|---|---|---|---|
| | Exposure conditions | | | | | | | | |
| | 10% R.H. | | | | 81% R.H. | | | | |
| Sample No. | yellow | magenta | cyan | light stain | yellow | magenta | cyan | light stain | Surface gloss |
| 1. Comparative sample | 72 | 51 | 49 | 0.12 (100) | 66 | 47 | 43 | 0.15 (100) | matted |
| 2. Comparative sample | 73 | 53 | 51 | 0.14 (117) | 62 | 49 | 45 | 0.16 (107) | insufficient gloss |
| 3. Comparative sample | 73 | 54 | 50 | 0.12 (100) | 63 | 49 | 44 | 0.15 (100) | insufficient gloss |
| 4. Sample of the present invention | 75 | 56 | 54 | 0.10 (83) | 73 | 55 | 53 | 0.10 (67) | good gloss |
| 5. Sample of the present invention | 75 | 55 | 53 | 0.10 (83) | 73 | 55 | 52 | 0.10 (67) | good gloss |

As in Example 4, the dispersions of UV absorber according to the present invention proved very effective in preventing the deterioration of light fastness and the increase in the amount of light stain in color diffusion transfer materials placed under hot and humid conditions. Samples 4 and 5 according to the present invention provided a high degree of surface gloss without causing a matted surface as in Sample 1. The surface gloss of Samples 2 and 3 prepared by the prior art technique was rather poor.

What is claimed is:

1. A silver halide color photographic light-sensitive element comprising a support having thereon at least one layer containing a dispersion of oil globules containing an ultraviolet absorber and a high-boiling solvent, wherein said ultraviolet absorber is a mixture of 15 to 45 wt% of a compound of the following formula (I) and 85 to 55 wt% of a compound of the following formula (II), and said high-boiling solvent is a compound represented by the following formula (III) or (IV):

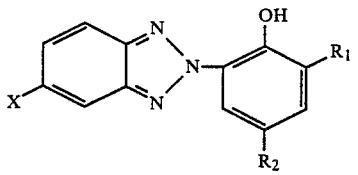

(I)

wherein $R_1$ and $R_2$ each represents an alkyl group having 1 to 4 carbon atoms, and X is a hydrogen atom, a halogen atom, a methyl group, an ethyl group, a methoxy group, an ethoxy group or an aryl group;

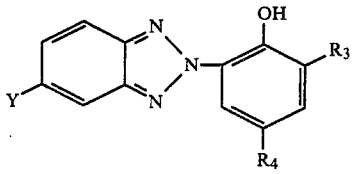

(II)

wherein $R_3$ and $R_4$ each represents an alkyl group, with the proviso that the total number of carbon atoms in the alkyl groups represented by $R_3$ and $R_4$ is 9 or more, and Y is a hydrogen atom, a halogen atom, a methyl group, an ethyl group, a methoxy group, an ethoxy group or an aryl group;

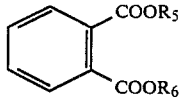

(III)

wherein $R_5$ and $R_6$ each represents an alkyl group, an alkenyl group, a cycloalkyl group or an aryl group;

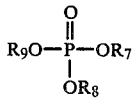

(IV)

wherein $R_7$, $R_8$ and $R_9$ each represents an alkyl group, an alkenyl group, a cycloalkyl group or an aryl group.

2. A silver halide color photographic light-sensitive element according to claim 1, wherein the total number of carbon atoms in the alkyl groups represented by $R_3$ and $R_4$ in said formula (II) is between 9 and 24.

3. A silver halide color photographic light-sensitive element according to claim 1, wherein $R_1$ in said formula (I) is

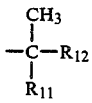

wherein $R_{11}$ and $R_{12}$ each represents a hydrogen atom, a methyl group or an ethyl group, with the proviso that the total number of carbon atoms in $R_{11}$ and $R_{12}$ is not mor than 2.

4. A silver halide color photographic light-sensitive element according to claim 1, wherein $R_2$ in said formula (I) is a propyl or butyl group.

5. A silver halide group photographic light-sensitive element comprising a support having thereon at least one layer containing a dispersion of oil globules containing an ultraviolet absorber and a high-boiling solvent, wherein said UV absorber is a mixture of 15 to 45 wt% of a compound of the following formula (I) and 85 to 55 wt% of a compound of the following formula (II), and said high-boiling solvent is a compound represented by the following formula (III) or (IV):

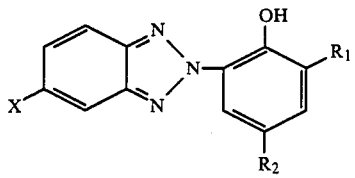

(I)

wherein $R_1$ is

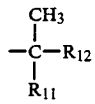

wherein $R_{11}$ and $R_{12}$ each represents a hydrogen atom, a methyl group or an ethyl group, with the proviso that the total number of carbo atoms in $R_{11}$ and $R_{12}$ is not mor than 2; $R_2$ is a propyl or butyl group; and X is a hydrogen atom, a halogen atom, a methyl group, an ethyl group, a methoxy group, an ethoxy group or an aryl group;

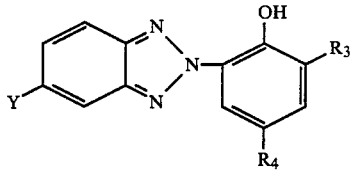

(II)

wherein $R_3$ and $R_4$ each represents an alkyl group, with the proviso that the total number of carbon atoms in the alkyl groups represented by $R_3$ and $R_4$ is 9 or more; and Y is a hydrogen atom, a halogen atom, a methyl group, an ethyl group, a methoxy group, an ethoxy group or an aryl group;

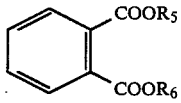

(III)

wherein $R_5$ and $R_6$ each represents an alkyl group, an alkenyl group, a cycloalkyl group or an aryl group;

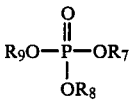

(IV)

wherein $R_7$, $R_8$ and $R_9$ each represents an alkyl group, an alkenyl group, a cycloalkyl group or an aryl group.

6. A silver halide color photographic light-sensitive element comprising a support having thereon at least one layer containing a dispersion of oil globules containing an ultraviolet absorber and a high-boiling solvent, wherein said UV absorber is a mixture of 15 to 45 wt% of a compound of the following formula (I) and 85 to 55 wt% of a compound of the following formula (II), and said high-boiling solvent is a compound represented by the following formula (III) or (IV):

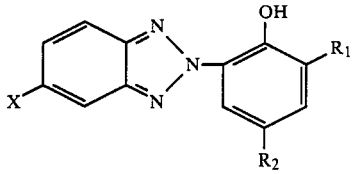

(I)

wherein $R_1$ and $R_2$ each represents an alkyl group having 1 to 4 carbon atoms; and X is a hydrogen atom, a halogen atom, a methyl group, an ethyl group, a methoxy group, an ethoxy group or an aryl group;

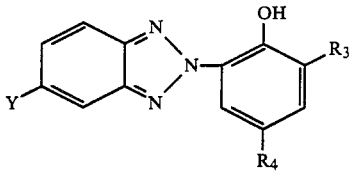

(II)

wherein $R_3$ is

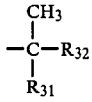

wherein $R_{31}$ and $R_{32}$ each represents a hydrogen atom or an alkyl group, with the proviso the total number of carbon atoms in $R_{31}$ and $R_{32}$ is between 2 and 4;

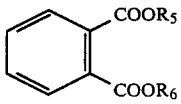

(III)

wherein $R_5$ and $R_6$ each represents an alkyl group, an alkenyl group, a cycloalkyl group or an aryl group;

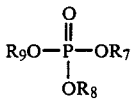

(IV)

wherein $R_7$, $R_8$ and $R_9$ each represents an alkyl group, an alkenyl group, a cycloalkyl group or an aryl group.

7. A silver halide color photographic light-sensitive element according to claim 6, wherein $R_4$ in said formula (II) is an alkyl group having 4 or more carbon atoms.

8. A silver halide color photographic light-sensitive element according to claim 1, wherein $R_4$ in said formula (II) is an alkyl group having 4 or more carbon atoms.

9. A silver halide color photographic light-sensitive element comprising a support having thereon at least one layer containing a dispersion of oil globules containing an ultraviolet absorber and a high-boiling solvent, wherein said UV absorber is a mixture of 15 to 45 wt% of a compound of the following formula (I) and 85 to 55 wt% of a compound of the following formula (II), and said high-boiling solvent is a compound represented by the following formula (III) or (IV):

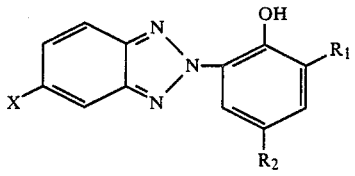

(I)

wherein $R_1$ and $R_2$ each represents an alkyl group having 1 to 4 carbon atoms; and X represents a hydrogen atom or a methyl group;

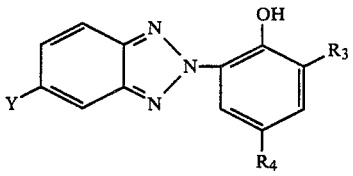

(II)

wherein $R_3$ and $R_4$ each represents an alkyl group, with the proviso that the total number of carbon atoms in the alkyl groups represented by $R_3$ and $R_4$ is 9 or more; and Y is a hydrogen atom, a halogen atom, a methyl group, an ethyl group, a methoxy group, an ethoxy group or an aryl group;

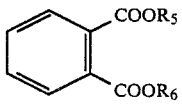

(III)

wherein $R_5$ and $R_6$ each represents an alkyl group, an alkenyl group, a cycloalkyl group or an aryl group;

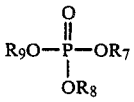

(IV)

wherein $R_7$, $R_8$ and $R_9$ each represents an alkyl group, an alkenyl group, a cycloalkyl group or an aryl group.

10. A silver halide color photographic light-sensitive element according to claim 8, wherein Y in said formula (II) represents a hydrogen atom, a chlorine atom, a methyl group or a methoxy group.

11. A silver halide color photographic light-sensitive element according to claim 1 wherein $R_5$, $R_6$, $R_7$, $R_8$ and $R_9$ in said formulas (III) and (IV) each represents an alkyl group having 8 to 16 carbon atoms.

* * * * *

UNITED STATES PATENT AND TRADEMARK OFFICE

CERTIFICATE OF CORRECTION

PATENT NO. : 4,790,959

DATED : December 13, 1988

INVENTOR(S) : Masao Sasaki et al.

It is certified that error appears in the above-identified patent and that said Letters Patent is hereby corrected as shown below:

Claim 3, column 32, line 56, change "mor" to --more--.

Claim 5, column 33, line 20, change "carbo" to --carbon--.

Claim 5, column 33, line 21, change "mor" to --more--.

Signed and Sealed this

Thirteenth Day of April, 1993

*Attest:*

STEPHEN G. KUNIN

*Attesting Officer*

*Acting Commissioner of Patents and Trademarks*